US005908285A

United States Patent [19]

Graff

[11] Patent Number: 5,908,285

[45] Date of Patent: Jun. 1, 1999

[54] ELECTROFORMED SHEATH

[75] Inventor: John M. Graff, West Suffield, Conn.

[73] Assignee: United Technologies Corporation, Hartford, Conn.

[21] Appl. No.: 08/401,833

[22] Filed: Mar. 10, 1995

[51] Int. Cl.[6] ..... F01D 5/14

[52] U.S. Cl. ..... 416/224; 416/213 R; 416/241 R; 205/67

[58] Field of Search ..... 416/224, 213 R, 416/229 A, 241 R; 205/67, 73

[56] References Cited

U.S. PATENT DOCUMENTS

| | | | |
|---|---|---|---|
| 3,554,874 | 1/1971 | Mattia | 204/9 |
| 3,628,890 | 12/1971 | Sayre et al. | 416/224 |
| 3,715,286 | 2/1973 | Knapp | 204/12 |
| 3,892,612 | 7/1975 | Carlson et al. | 416/224 |
| 4,111,600 | 9/1978 | Rothman et al. | 416/224 |
| 4,156,306 | 5/1979 | Seidel et al. | 29/2 |
| 4,501,646 | 2/1985 | Herbert | 204/4 |
| 4,564,423 | 1/1986 | Dugan | 204/12 |
| 4,586,226 | 5/1986 | Fakler et al. | 29/157 |
| 4,720,244 | 1/1988 | Kluppel et al. | 416/224 |
| 4,781,799 | 11/1988 | Herbert, Jr. et al. | 204/9 |
| 4,902,386 | 2/1990 | Herbert et al. | 204/9 |
| 4,950,375 | 8/1990 | Leger | 204/224 |
| 5,674,370 | 10/1997 | DuPree | 205/67 |

FOREIGN PATENT DOCUMENTS

| | | | |
|---|---|---|---|
| 2039526 | 8/1980 | United Kingdom | 416/224 |
| WO9509937 | 4/1995 | WIPO | 76/101.1 |

*Primary Examiner*—Edward K. Look
*Assistant Examiner*—Richard Woo
*Attorney, Agent, or Firm*—Malcolm J. Chisholm, Jr.

[57] ABSTRACT

An electroformed sheath is disclosed for protecting composite components of a part, such as a fan blade of a modern gas turbine engine. The electroformed sheath includes a sheath body having a leading edge; a pressure side and an opposed suction side of the body that meet at the leading edge and extend away from the leading edge to define a sheath cavity therebetween; a head section of the body between the leading edge and the sheath cavity; and an electrically conductive mandrel insert positioned between the pressure and suction sides of the body. In manufacture of the electroformed sheath, the mandrel insert is secured in an appropriate mandrel having an exterior surface approximating the blade's airfoil configuration. The leading edge, head section and pressure and suction sides are electroplated around the mandrel insert so that the insert remains in the sheath body after removal of the mandrel. The position occupied by the mandrel defines the sheath cavity, and the component parts of the blade are secured within the cavity. The mandrel insert enhances electroformation of material from the electroplate bath around the mandrel insert so that the resulting electroformed sheath has a thickness range ratio (being a ratio of the thickness of a thickest part of the sheath (e.g., its leading edge) to the thickness of a thinnest part of the sheath (e.g., trailing edges of the pressure or suction sides)) in excess of 30:1.

10 Claims, 3 Drawing Sheets

ELECTROFORMED SHEATH

TECHNICAL FIELD

The present invention relates to electroformed parts and in particular relates to an electroformed sheath for protecting a leading edge of a fan blade of a modern gas turbine engine.

BACKGROUND OF THE INVENTION

To increase operating efficiencies of modern aircraft engines it is desirable to decrease weights of component parts. Substantial decreases in weights of components, such as propeller blades, have been achieved through use of composite materials, including for example graphite fiber reinforcements within an epoxy matrix. Composite blades, however, must be reinforced at their leading edges to provide adequate strength to protect the blade from erosion and foreign object damage, and especially from damage as a result of leading edge impact with birds, ice, stones, rain and other debris.

As is well known in propeller blade technology, adequate protection of a leading edge of a composite propeller blade is achieved by securing an electroformed nickel sheath to the leading edge. Manufacture of such electroformed sheaths is well known, as described for example in U.S. Pat. No. 4,950,375 to Leger, which Patent is hereby incorporated herein by reference. Typically, a die or mandrel, made of a conductive material such as titanium, is formed to have an exterior surface that conforms to a blade's airfoil configuration minus the thickness of the sheath to be electroformed on the mandrel. Desired thicknesses of the sheath are achieved by a well known process of "shielding", wherein barrier walls or shields are placed adjacent the mandrel in such positions that the shields direct the flow of an electroplate solution when the mandrels are placed in an electroplate bath. For example, where a sheath leading edge must be thicker, and hence stronger, than a sheath trailing edge, a shield portion adjacent a first surface section of the mandrel upon which is formed the sheath leading edge would be positioned a greater distance from that surface section of the mandrel than a shield portion adjacent a second surface section of the mandrel upon which is formed the sheath trailing edge. After the mandrel has been in the electroplate bath for a pre-determined length of time, it is removed; the electroformed sheath is next mechanically removed from the mandrel; and the sheath is then machined to smoothly fit over a composite component of the blade, in a manner well known in the art.

While electroformed sheaths have provided satisfactory protection for propeller blades, known sheaths are as yet inadequate for application to higher speed parts, such as fan blades of gas turbine engines. First stage fan blades of high bypass or advanced ducted engines in particular have become larger and travel at increasingly higher speeds to achieve desired performance requirements. Consequently the momentum of such blades is so great that blades made of composite materials having standard electroformed sheaths are not sufficiently strong to withstand ordinary foreign object damage within desired operational ranges of the blades. Therefore, most fan blades in modern gas turbine engines are manufactured of a hollowed-out metal, such as titanium, at extreme cost in labor and materials. The resulting all metal blades are much heavier than equivalent sized fan blades made of composite materials with an electroformed sheath.

Known electroformed sheaths are typically limited so that a ratio of the thickness of a thickest part of the sheath (e.g., the leading edge of the sheath) to the thickness of the thinnest part of the sheath (e.g., the trailing edge of the sheath) is generally 5:1, and may reach 10:1 at great cost. (The aforesaid ratio being hereinafter referred to as the "thickness range ratio".) For example, standard constraints of manufacture of the resulting blade require that the trailing edge of the sheath be no greater than 0.006 inches thick; which means 0.006 inches between an exterior surface of the trailing edge and an opposed inner surface of the trailing edge that contacts the composite material. Consequently, based on the thickness range ratio of existing electroformed sheaths, the leading edge can be no thicker than 0.030 to 0.060 inches. Appropriate strength requirements for electroformed sheaths on modern fan blades, however, mandate that the leading edge be approximately 0.500 inches thick, while manufacturing constraints require that the trailing edge remain at approximately 0.006 inches thick; being a thickness range ratio of approximately 80:1.

Accordingly, it is the general object of the present invention to provide an improved electroformed sheath that overcomes the strength, weight and cost problems of the prior art.

It is a more specific object to provide an electroformed sheath that affords adequate strength for protection of composite material components of a part such as a fan blade of a modern gas turbine engines.

It is a further specific object to provide an electroformed sheath for a part such as a fan blade that enhances the structural integrity of a leading edge of the blade.

It is another specific object to provide an electroformed sheath that facilitates affixation of the sheath to composite material components of a part.

It is yet another object to provide an electroformed sheath having a sufficiently thick leading edge to enable re-contouring or repair of the sheath to extend its useful life.

It is still another object to provide an electroformed sheath that may be fabricated by known manufacturing processes.

The above and other advantages of this invention will become more readily apparent when the following description is read in conjunction with the accompanying drawings.

DISCLOSURE OF THE INVENTION

An electroformed sheath is disclosed for protecting a leading edge of a part such as a blade. In accordance with the invention, the electroformed sheath comprises a sheath body having a leading edge; a pressure side and an opposed suction side, which sides meet at the leading edge and extend away from the leading edge ending at pressure and suction side trailing edges to define a sheath cavity therebetween; a head section of the body between the leading edge and the sheath cavity; and an electrically conductive mandrel insert positioned between the pressure side and suction sides of the body.

In manufacture of the present invention, the mandrel insert is secured to an appropriate mandrel or die which has an exterior surface that conforms to the blade's airfoil configuration, minus the thickness of a sheath to be electroformed on the mandrel. The mandrel insert is secured to the mandrel at a leading edge position of the mandrel which position coincides with a leading edge section of the blade's airfoil configuration. When the mandrel and mandrel insert are placed in an appropriate electroplate bath, the leading edge, pressure and suction sides and head section form around conductive surfaces of the mandrel and mandrel insert to form the sheath body with the insert. When the body is removed from the mandrel, the mandrel insert remains in the sheath body, and the sheath cavity is defined within the body by the area previously occupied by the mandrel. In a first embodiment, the mandrel insert extends from the head section into the sheath cavity to facilitate affixation of the sheath body to composite components of the blade. In a second embodiment, the mandrel insert is within the head section. The electroformed sheath is then secured to a composite component of the blade in a manner well known in the art.

The mandrel insert enhances electroformation of material from the electroplate bath around the leading edge position of the mandrel so that the resulting electroformed sheath has a thickness range ratio (being a ratio of the thickness of the thickest part of the sheath (e.g., its leading edge) to the thickness of the thinnest part of the sheath (e.g., either trailing edge)) in excess of 30:1.

BEST MODE FOR CARRYING OUT THE INVENTION

Figure 1:
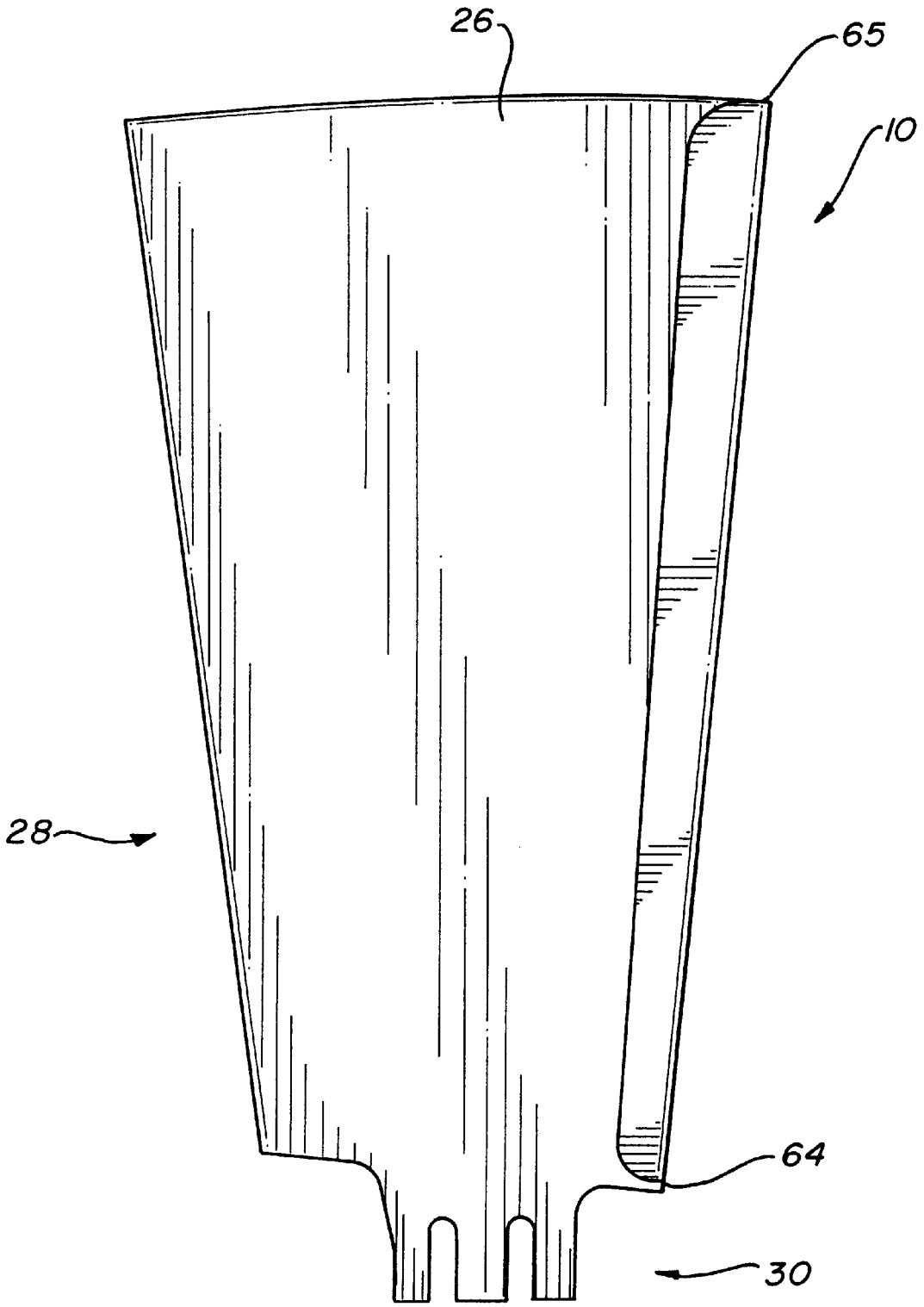
FIG. 1 is a flat plan view of a fan blade of a modern gas turbine engine employing an electroformed sheath constructed in accordance with the present invention.
Figure 3:
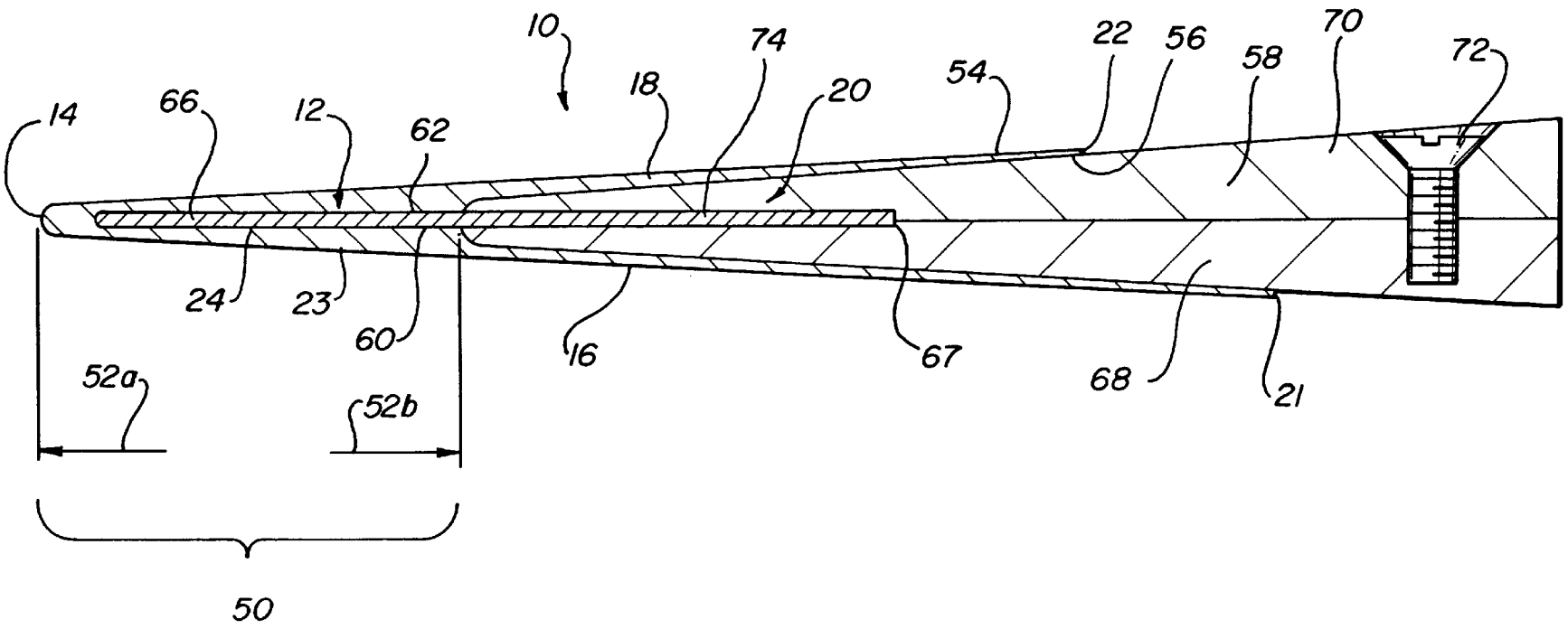
FIG. 3 is a cross-sectional view of an electroformed sheath constructed in accordance with the present invention, showing the sheath on an electroplating mandrel.

Referring to the drawings in detail, an electroformed sheath of the present invention is shown in FIGS. 1 and 3 and generally designated by the reference numeral 10. As best seen in FIG. 3, the electroformed sheath 10 includes a sheath body 12 having a leading edge 14; a pressure side 16 and an opposed suction side 18, which sides meet at the leading edge 14 and extend away from the leading edge to define a sheath cavity 20, and end at a pressure side trailing edge 21 and a suction side trailing edge 22; a head section 23 of the body between the leading edge 14 and the cavity 20; and an electrically conductive mandrel insert 24 positioned between the pressure and suction sides 16, 18 of the sheath body 12. FIG. 1 shows the electroformed sheath 10 affixed to composite components 26 (such as graphite fiber reinforcements within an epoxy matrix) of a fan blade 28. The fan blade is a type commonly secured by a fan blade mounting arm 30 to a modern gas turbine engine (not shown).

Figure 2:
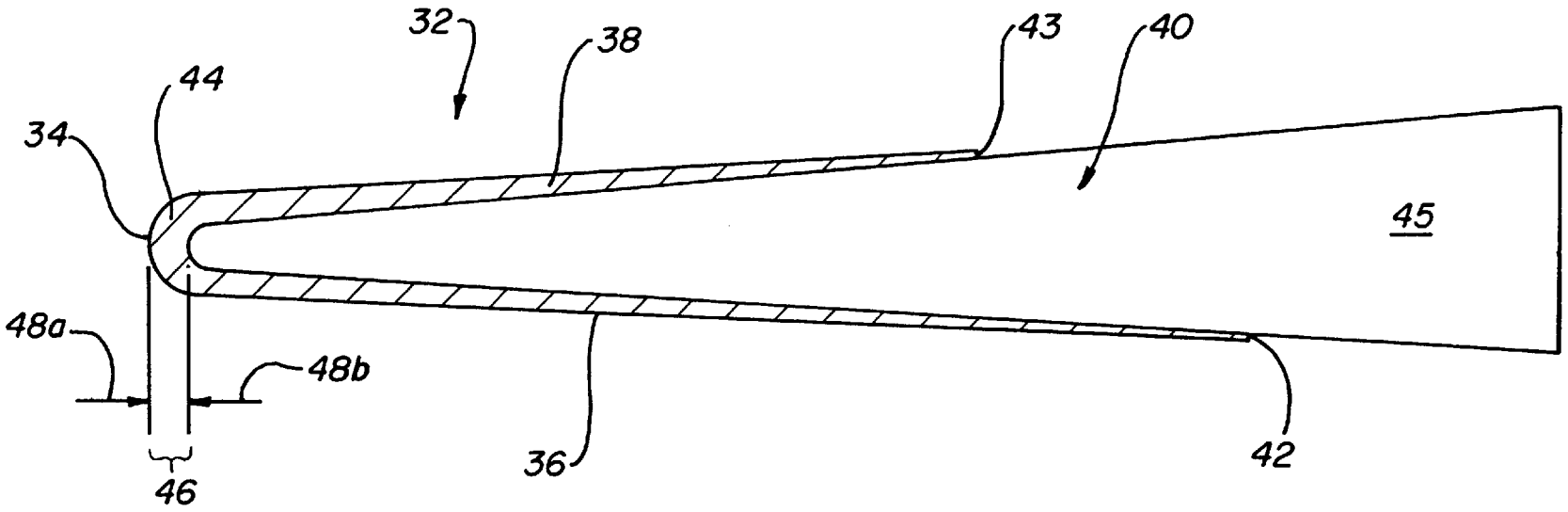
FIG. 2 PRIOR ART
FIG. 2 is cross-sectional view of a prior art electroformed sheath, showing the sheath on an electroplating mandrel.

As seen in FIG. 2, a prior art electroformed sheath 32 has similar elements (for purposes of distinguishing over the present invention, the words and/or phrases representing the elements of the prior art sheath include the prefix "PA-"), including a PA-leading edge 34; a PA-pressure side 36 and a PA-suction side 38, which sides extend from the PA-leading edge to define a PA-cavity 40, and end at a PA-pressure side trailing edge 42 and a PA-suction side trailing edge 43; and a PA-head section 44 extending from the PA-leading edge to the PA-cavity 40. The prior art electroformed sheath 32 is formed on a PA-mandrel 45, in a manner well known in the art.

The prior art electroformed sheath 32 has a thickness range ratio (which is hereinafter a ratio of the thickest part of a sheath 10 or 32 (being for sheath 32 the PA-head section 44) to the thinnest part of sheath 10 or 32 (being for sheath 32 the PA-pressure 42 or PA-suction side trailing edge 43)) of between 5:1 and 10:1. Consequently an axial length of the PA-head section 44 (being the length along an axis equidistant between the PA-pressure and PA-suction sides 42, 43 extending from the PA-leading edge 34 to the PA-cavity 40) is limited to a specific maximum length 46, being the distance between PA-distance lines 48*a*, 48*b*. In contrast, the thickness range ratio of the present invention electroformed sheath 10 may be equal to or greater than 30:1. Therefore an axial length (measured along the same axis as described above for PA-head section 44) of head section 23 may be a length 50, being the distance between distance lines 52*a*, 52*b*, as shown schematically (and not to scale) in FIG. 3.

It has been determined that, where a thickness of either the pressure or suction side trailing edges 21, 22 (measured for example from an exterior surface 54 of suction side trailing edge 22 to an opposed interior surface 56 of the suction side trailing edge that contacts a mandrel 58) is 0.006 inches, the axial length 50 of the head section 23 of the electroformed sheath 10 of the present invention may be as long as 0.500 inches, representing a thickness range ratio of approximately 83:1. Where the electroplated material in the electroplate bath that is deposited around the mandrel insert 24 and mandrel 58 to form the electroformed sheath is nickel, and the mandrel insert is made of titanium, a minimum hardness rating of 533 VHS (Vickers Hardness Scale) may be achieved.

The mandrel insert 24 is formed to have any functional shape and any thickness (measured for example from an insert pressure surface 60 to and opposed insert suction surface 62) that is equal to or less than a thickness of the sheath body 12 adjacent the mandrel insert 24, and an optimal thickness of the mandrel insert has been determined to be between 0.01 to 0.02 inches. The insert 24 has a width that is approximately the same as a width of the leading edge 14 of the resulting electroformed sheath 10 (the width being measured from a sheath inner edge 64 to a sheath outer edge 65, as shown in FIG. 1). A forward section 66 of the mandrel insert 24 lies within the head section 23 between the leading edge 14 and sheath cavity 20 and has an axial length (measured along an axis parallel to the above referenced axial length axis of the head section) that is at least 50% of the axial length of the head section 23, so that the axial length of the forward section 66 would be at least 0.25 inches if the axial length of the head section 23 is about 0.50 inches. The mandrel insert 24 may be made of stainless steel, plated nickel, plated nickel-cobalt, copper, zinc, titanium materials coated with those conductive materials, or any conductive materials that are sufficiently conductive to afford electroplate formation of a sheath having a thickness range ratio of approximately 30:1 or greater.

As best seen in FIG. 3, the mandrel insert 24 may be positioned in a mandrel slot 67 of mandrel 58, which slot 67 may be formed in a one piece mandrel (not shown), or defined between a first mandrel half 68 and second mandrel half 70 of the mandrel 58, which halves are secured together by a mandrel screw 72.

In use of the electroformed sheath 10, a mandrel insert 24 is secured within the mandrel slot 66, as for example by clamping the first and second mandrel halves 68, 70 on the insert 24 and securing the halves together with the mandrel screw 72. The mandrel 58 and secured insert 24 are then placed within an appropriate electroplate bath for a predetermined time necessary for the head section 12 and pressure and suction sides to be electroplated around the insert 24 and mandrel 58. The mandrel is then removed from the bath, and the sheath 10 is mechanically removed from the mandrel in a manner well known in the art, so that the sheath cavity 20 is defined between the pressure side 12 and suction side 14 of the sheath body 12 by the position previously occupied by the mandrel 58.

In a first embodiment, a tail section 74 of the mandrel insert 24 extends from the head section 23 into the sheath cavity 20. In a second embodiment, the tail section 74 is removed and only the forward section 65 of the mandrel insert 24 lies within the head section 23. After the electroformed sheath 10 is removed from the mandrel 58, it is affixed to composite components 26 so that the composite components fill the sheath cavity 20 and are secured to the sheath body 12 in a manner well known in the art, such as a resin transfer molding process. If an electroformed sheath 10 manufactured in accordance with the second embodiment is used so that the tail section 74 of the mandrel insert remains and extends into the sheath cavity, bonding of the composite materials to the tail section 74 enhances strength of the bond between the sheath 10 and the composite components 26.

Ordinary high-speed rotation of the resulting fan blade 28 will result in contact with foreign objects being limited to contact with the leading edge 14 of the blade. Before any such foreign object could reach and damage the composite components of the blade 28, it would have to completely penetrate the entire head section 23 of the sheath body 12 (as shown in FIG. 3). Consequently because of the length of the head section 23, the electroformed sheath 10 of the present invention affords substantially enhanced protection for a part such as fan blade 28 than does the prior art electroformed sheath 32, as seen in FIG. 2.

While the present invention has been described and illustrated with respect to a particular construction of a fan blade, it will be understood by those skilled in the art that the present invention is not limited to this particular example. For example the electroformed sheath 10 and process for its manufacture and use may be applied to electroformed parts for many uses, such as protection of composite components of exit guide vanes in a gas turbine engine, as well as for parts in non-gas turbine engine operating environments. Accordingly, reference should be made primarily to the attached claims rather than the foregoing specification to determine the scope of invention.

I claim:

1. An electroformed sheath for protecting a part, comprising:

a. a sheath body having a leading edge;

b. a pressure side and an opposed suction side of the body which sides meet at the leading edge and extend away from the leading edge to define a sheath cavity between the sides;

c. a head section of the body between the leading edge and the sheath cavity; and d. an electrically conductive mandrel insert positioned between the pressure side and suction side, the electrically conductive mandrel insert being dimensioned to have a thickness from an insert pressure surface to an opposed insert suction surface that is less than a shortest distance through the sheath cavity from the suction side to the pressure side of the sheath body; wherein the part fills the sheath cavity in affixing the electroformed sheath to the part so that the leading edge and the head section protect the part.

2. The electroformed sheath of claim 1, wherein the electroformed sheath has a thickness range ratio greater than 30:1, so that a thickness of a thickest part of the electroformed sheath is greater than thirty times a thickness of a thinnest part of the electroformed sheath.

3. The electroformed sheath of claim 2, wherein the thickest part of the electroformed sheath is the head section and the thinnest part of the electroformed sheath is a trailing edge of the sheath body.

4. The electroformed sheath of claim 1, wherein a forward section of the mandrel insert that lies within the head section between the leading edge and the sheath cavity has an axial length at least 50% of an axial length of the head section.

5. The electroformed sheath of claim 1, wherein the mandrel insert lies within the head section between the leading edge and the sheath cavity.

6. The electroformed sheath of claim 1, wherein a tail section of the mandrel insert extends from the head section into the sheath cavity.

7. The electroformed sheath of claim 1, wherein the mandrel insert is about 0.01 to about 0.02 inches thick and has an axial length of at least 0.25 inches, and the head section has an axial length of about 0.50 inches.

8. A method of protecting composite components of a part with an electroformed sheath, comprising the steps of:

a. securing an electrically conductive mandrel insert in a mandrel;

b. electroplating in an electroplate bath a head section and pressure and suction sides around the mandrel insert to form with the mandrel insert a sheath body;

c. removing the mandrel from the sheath body so that a sheath cavity is defined within the sheath body by the position occupied by the mandrel and a tail section of the mandrel insert projects from the head section into the sheath cavity to form the electroformed sheath; and, d. securing composite components of the part within the sheath cavity so that the electroformed sheath protects the composite components.

9. The method of protecting composite components of a part with an electroformed sheath of claim 8, comprising the further step of removing the tail section from the electroformed sheath before securing the composite components of the part within the sheath cavity.

10. The method of protecting composite components of a part with an electroformed sheath of claim 8, comprising the further step of using a resin transfer molding process to secure the composite components within the sheath cavity.

* * * * *